US012714134B2

(12) United States Patent
Link et al.

(10) Patent No.: US 12,714,134 B2
(45) Date of Patent: Aug. 25, 2026

(54) METHODS OF TREATING TOBACCO AND TREATED TOBACCO

(71) Applicant: British American Tobacco (Investments) Limited, London (GB)

(72) Inventors: Matthias Link, Hamburg (DE); Josef Knothe, Hamburg (DE); Frank Plueckhahn, Hamburg (DE)

(73) Assignee: British American Tobacco (Investments) Limited, London (GB)

( * ) Notice: Subject to any disclaimer, the term of this patent is extended or adjusted under 35 U.S.C. 154(b) by 376 days.

(21) Appl. No.: 17/802,110

(22) PCT Filed: Feb. 25, 2021

(86) PCT No.: PCT/GB2021/050482
§ 371 (c)(1),
(2) Date: Aug. 24, 2022

(87) PCT Pub. No.: WO2021/171022
PCT Pub. Date: Sep. 2, 2021

(65) Prior Publication Data

US 2023/0085597 A1 Mar. 16, 2023

(30) Foreign Application Priority Data

Feb. 27, 2020 (GB) ..... 2002796

(51) Int. Cl.
*A24B 15/24* (2006.01)
*A24B 15/10* (2006.01)

(52) U.S. Cl.
CPC ..... *A24B 15/243* (2013.01); *A24B 15/10* (2013.01)

(58) Field of Classification Search
CPC ..... A24B 15/243; A24B 15/10
See application file for complete search history.

(56) References Cited

U.S. PATENT DOCUMENTS 1,577,768 A 3/1926 Smith
1,880,336 A 10/1932 Wenusch
(Continued)

FOREIGN PATENT DOCUMENTS

CN 1748586 A 3/2006
GB 190625403 A 4/1907
(Continued)

OTHER PUBLICATIONS

International Search Report and Written Opinion for Application No. PCT/GB2021/050482, mailed on Jun. 2, 2021, 21 pages.
(Continued)

*Primary Examiner* — Christopher M Rodd
*Assistant Examiner* — Jennifer A Kessie
(74) *Attorney, Agent, or Firm* — WOMBLE BOND DICKINSON (US) LLP

(57) ABSTRACT

A method of treating tobacco material with superheated steam to reduce the nicotine content of the tobacco material after the treatment compared to the nicotine content of the tobacco material before the treatment. Also provided is treated tobacco material which has been contacted with superheated steam to reduce its nicotine content, as well as the use of superheated steam to treat tobacco and tobacco industry products that include the treated tobacco material.

15 Claims, 2 Drawing Sheets

(56) References Cited

U.S. PATENT DOCUMENTS

| | | | | |
|---|---|---|---|---|
| 2,309,975 | A | 2/1943 | Moseley et al. | |
| 4,068,671 | A | 1/1978 | Casey | |
| 4,094,323 | A | 6/1978 | Frazier et al. | |
| 4,677,994 | A * | 7/1987 | Denier | A24B 15/28 131/300 |
| 4,819,667 | A | 4/1989 | Drazic | |
| 5,740,817 | A | 4/1998 | Cunningham | |
| 5,873,372 | A * | 2/1999 | Honeycutt | A24B 3/182 131/309 |
| 6,718,988 | B1 | 4/2004 | Cooper et al. | |
| 2007/0007473 | A1 | 1/2007 | Kumagai | |

FOREIGN PATENT DOCUMENTS

| | | | |
|---|---|---|---|
| GB | 190728536 | | 11/1908 |
| GB | 290204 | A | 6/1929 |
| GB | 363614 | A | 12/1931 |
| GB | 969144 | A | 9/1964 |
| KR | 19970008065 | B1 | 12/1994 |
| NL | 7709837 | A | 6/1978 |
| WO | 0121017 | A1 | 3/2001 |
| WO | 2001021017 | A1 | 3/2001 |
| WO | 2014080226 | A1 | 5/2014 |
| WO | 2014140346 | A1 | 9/2014 |
| WO | 2019175552 | A1 | 9/2019 |

OTHER PUBLICATIONS

Kim et al., "Effect of Super Heated Steam Treatment on Physical Property and Smoke Component of Burley Cut Tobacco," Journal of the Korean Society of Tobacco Science, Oct. 14, 1995, vol. 17, No. 2, pp. 139-148.

Xue, F. et al., "Effect of tobacco stem treated by steam explosion on the release of harmful chemicals in cigarette smoke", Asian Journal of Chemistry, 2014.

Cheon Suk-Kim et al., "The effect of super steam treatment on the chemical constituents of tobacco", CORESTA Meeting, Vienna 1995, ST17.

* cited by examiner

Fig. 3

| | Process pressure [bar(g)] | Process Temperature [°C] | Moisture (OV) before process [%] | Process time [min] | Moisture (OV) after process [%] | Sugar Reduction [%] | Ammonia Reduction [%] | Nicotine Reduction [%] |
|---|---|---|---|---|---|---|---|---|
| Tobacco Material 1 | 1.5 | 150 - 160 | 24 | 6 | 5 | 27 | 63 | 18 |
| Tobacco Material 1 | 2.5 | 140 - 150 | 24 | 6 | 11 | 32 | 67 | 26 |
| Tobacco Material 1 | 2.5 | 150 - 160 | 24 | 6 | 8 | 51 | 83 | 57 |
| Tobacco Material 1 | 2.5 | 160 - 170 | 24 | 6 | 4 | 60 | 87 | 65 |
| Tobacco Material 1 | 3.5 | 160 - 170 | 24 | 6 | 5 | 73 | 90 | 78 |
| Tobacco Material 2 | 2.5 | 140 - 150 | 33 | 12 | 10 | 45 | 73 | 34 |
| Tobacco Material 2 | 2.5 | 150 - 160 | 33 | 12 | 7 | 63 | 77 | 64 |
| Tobacco Material 2 | 2.5 | 160 - 170 | 33 | 12 | 5 | 87 | 85 | 83 |
| Tobacco Material 3 | 2.5 | 150 - 160 | 33 | 3 | 5 | n.a. | 73 | 49 |
| Tobacco Material 3 | 2.5 | 150 - 160 | 33 | 6 | 4 | n.a. | 79 | 60 |

METHODS OF TREATING TOBACCO AND TREATED TOBACCO

PRIORITY CLAIM

The present application is a National Phase entry of PCT Application No. PCT/GB2021/050482, filed Feb. 25, 2021, which claims priority from GB Application No. 2002796.7, filed Feb. 27, 2020, each of which is hereby fully incorporated herein by reference.

TECHNICAL FIELD

The invention relates to methods of treating tobacco material to reduce the nicotine content of the tobacco material. In particular, the methods involve contacting the tobacco material with superheated steam to reduce the nicotine content. The invention also relates to tobacco material treated by the methods and having a reduced nicotine content, as well as the use of superheated steam at elevated pressure to reduce the nicotine content of tobacco material.

BACKGROUND

It is known to treat tobacco material for the purpose of removing nicotine, for example in order to reduce the nicotine content in smoke generated when the tobacco is combusted. Disadvantages associated with known processes include the application of chemicals to achieve the desired removal of nicotine. Furthermore, the known processes are often designed to treat batches of tobacco, rather than being continuous processes for extraction.

SUMMARY

In a first aspect of the invention there is provided a method of treating tobacco material with superheated steam having temperature of from about 100° C. to about 300° C. at a pressure of from about 0.05 bar(g) to about 10 bar(g) for a period of from about 1 minute to about 30 minutes, wherein the tobacco material has a moisture content before the treatment of at least about 15% OV and wherein the nicotine content of the tobacco material after the treatment is reduced compared to the nicotine content of the tobacco material before the treatment.

In some embodiments, the nicotine content of the tobacco material after the treatment is at least about 20%, at least about 25% or at least about 40% less than the nicotine content of the tobacco material before the treatment.

In some embodiments, the nicotine content of the tobacco material after the treatment is up to about 90% less than the nicotine content of the tobacco material before the treatment.

In some embodiments, the moisture content of the tobacco material is higher before the treatment than after the treatment.

In some embodiments, the tobacco material has a moisture content before the treatment of from about 20% OV to about 40% OV.

In some embodiments, the tobacco material has a moisture content after the treatment of no more than about 15% OV.

In some embodiments, the tobacco material has a moisture content after the treatment of from about 3% to about 15% OV or from about 4% OV to about 7% OV.

In some embodiments, the method comprises treating the tobacco material for a period of from about 2 minutes to about 12 minutes.

In some embodiments, the pressure is from about 1 bar(g) to about 4 bar(g).

In some embodiments, the temperature of the superheated steam in the process chamber is from about 100° C. to about 300° C., or from about 130° C. to about 170° C.

In some embodiments, the tobacco is treated in a continuous process.

In some embodiments, the tobacco material is introduced into and conveyed through a pressurized treatment chamber, where it is contacted with the superheated steam.

In some embodiments, the tobacco material is sprayed with the superheated steam.

In some embodiments, the tobacco material is agitated as it is conveyed through the treatment chamber.

In other embodiments, the tobacco is treated in a batch process.

In some embodiments, the sugar content of the tobacco material after the treatment is reduced compared to the sugar content of the tobacco material before the treatment.

In some embodiments, the ammonia content of the tobacco material after the treatment is reduced compared to the ammonia content of the tobacco material before the treatment.

In some embodiments, the sensorial properties of the tobacco material after the treatment are improved compared to the sensorial properties of the tobacco material before the treatment.

In some embodiments, the tobacco material undergoes two or more cycles of treatment with superheated steam having temperature of from about 100° C. to about 300° C. at a pressure of from about 0.05 bar(g) to about 10 bar(g) for a period of from about 1 minute to about 30 minutes.

According to a second aspect of the invention, there is provided a treated tobacco material obtained or obtainable by a method according to the first aspect of the invention.

According to a third aspect of the invention, there is provided a treated tobacco material which has been contacted with superheated steam to reduce its moisture content, wherein the treated tobacco material has a reduced nicotine content compared to the nicotine content of the tobacco material before it was treated.

In some embodiments, the treated tobacco material has one or more of: a reduced sugar content compared to the sugar content of the tobacco material before the treatment; a reduced ammonia content compared to the ammonia content of the tobacco material before the treatment; and improved sensorial properties compared to the sensorial properties of the tobacco material before the treatment.

According to a fourth aspect of the invention, there is provided a use of superheated steam having temperature of from about 100° C. to about 300° C. and a pressure of from about 0.05 bar(g) to about 10 bar(g) to reduce the nicotine content of tobacco material.

In some embodiments, the superheated steam is applied to the tobacco material for a period of from about 1 minute to about 30 minutes.

In some embodiments, the tobacco material has a moisture content of at least about 15% OV before the superheated steam is applied.

In some embodiments, the nicotine content is reduced by at least about 20%.

In some embodiments, the nicotine content is reduced by up to about 90%.

In some embodiments, the moisture content of the tobacco material is reduced.

According to a fifth aspect of the invention, there is provided a treated tobacco material obtained or obtainable by a use according to the fourth aspect of the invention.

According to a sixth aspect of the invention, there is provided a tobacco industry product comprising the treated tobacco material according to the second or fifth aspects of the invention.

In some embodiments, the tobacco industry product is a component for use in a tobacco-heating device.

According to a seventh aspect of the invention, there is provided a use of the treated tobacco material according to the second or fifth aspects of the invention, for the manufacture of a tobacco industry product.

BRIEF DESCRIPTION OF THE DRAWINGS

For the purposes of example only, embodiments of the invention are described below with reference to the accompanying drawings, in which:

FIG. 3 is a table showing the process parameters used in the study of the Example, and the results of the analysis of the resultant treated tobacco.

DETAILED DESCRIPTION OF THE DRAWINGS

Figure 1:
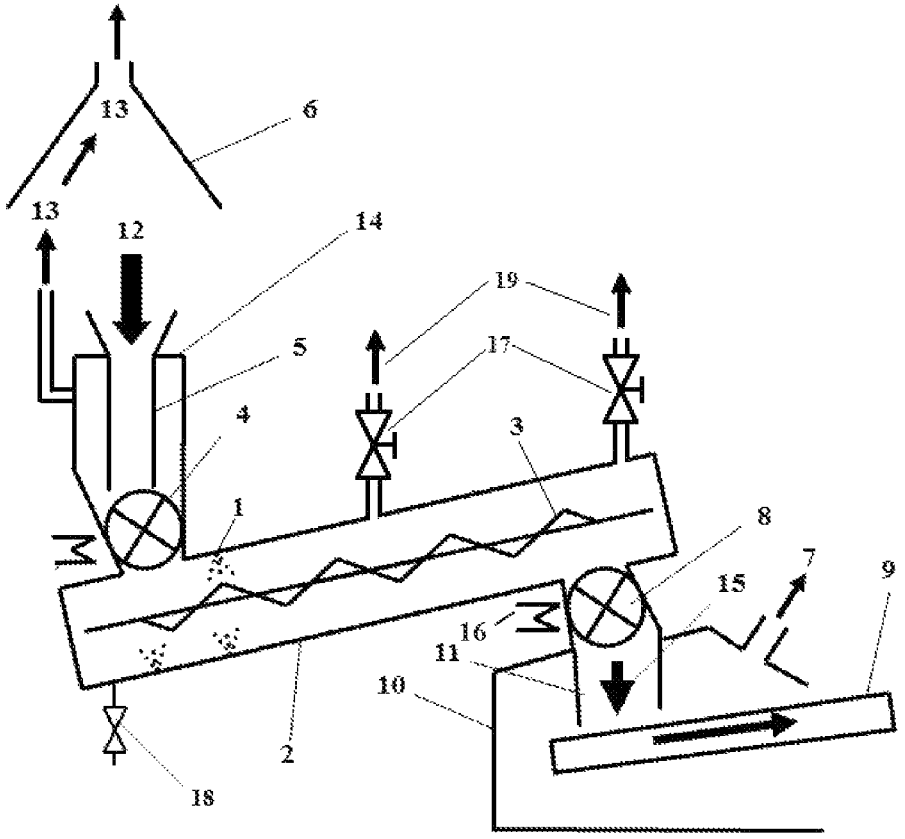
FIG. 1 shows a schematic representation of an apparatus for carrying out the methods disclosed herein.

The present invention relates to a method for treating tobacco material to remove nicotine from the tobacco material so that the treated tobacco material has a nicotine content that is reduced compared to the nicotine content of the tobacco material prior to said treatment. As used herein, the term "treated tobacco" refers to tobacco that has undergone the treatment process, and the term "untreated tobacco" refers to (the same) tobacco that has not undergone the treatment process.

Previously disclosed processes have often focused on adjusting the pH of the tobacco material in order to enhance nicotine removal. For example, U.S. Pat. No. 4,068,671 (AMF Inc.) discloses forming an alkaline aqueous dispersion of tobacco, which is rapidly dried to remove nicotine. The rapid drying may be by belt drying or spray drying the suspension of tobacco material. Netherlands Patent Application No. 7709837 (Coffex AG) discloses treating moistened tobacco having a pH of 8-9.5 with dry air containing ozone.

In contrast to these previous approaches, the present method utilizes the application of superheated steam. Surprisingly, this treatment removed nicotine and optimization of the treatment parameters can lead to significant reduction in nicotine content. In some embodiments, the reduction in nicotine may be achieved without altering the pH of the tobacco and/or without the addition of an additive.

Not all treatment of tobacco material with superheated steam leads to effective removal of nicotine. The inventors have identified that nicotine content is reduced when tobacco material is treated with superheated steam having temperature of from about 100° C. to about 300° C. at a pressure of from about 0.05 bar(g) to about 10 bar(g) for a period of from about 1 minute to about 30 minutes, wherein the tobacco material has a moisture content before the treatment of at least about 15% OV.

Superheated steam is steam at a temperature higher than its vaporization point at the absolute pressure where the temperature is measured. When water is heated to a temperature higher than its boiling point, it vaporizes into steam. Saturated steam (or dry steam) is generated when all of the water is heated to its boiling point and so 100% of the water is in the gaseous phase (i.e. there is no entrained liquid water). When saturated steam is further heated beyond this saturation point, it becomes superheated steam.

The temperature of the superheated steam is defined as the temperature of the superheated steam directly prior to its application to the tobacco material. In some embodiments, the temperature of the superheated steam is from about 130° C. to about 170° C. In some embodiments the temperature is at least about 100° C., 110° C., 120° C., 130° C., 140° C., 150° C., 160° C., 170° C., 180° C., 190° C. or at least about 200° C., and/or up to about 300° C., 290° C., 280° C., 270° C., 260° C., 250° C., 240° C., 230° C., 220° C., 210° C., 200° C., 190° C., 180° C., 170° C., 160° C. or up to about 150° C.

The pressure at which the method is carried out is defined as the pressure in the section, chamber or area where the superheated steam is applied to the tobacco material. In some embodiments, the pressure is from about 1 bar(g) to about 4 bar(g). In some embodiments, the pressure is at least about 0.05 bar(g), 0.1, 0.2, 0.4, 0.6, 0.8, 1, 1.5, 2, 2.5, 3, 3.5, 4, 4.5, 5, 5.5, 6, 6.5, 7, 7.5 or at least about 8 bar(g), and/or up to about 10 bar(g), 9.5, 9, 8.5, 8, 7.5, 7, 6.5, 6, 5.5, 5, 4.5, 4, 3.5 or about 3 bar(g).

If the pressure is above about 1 bar(g), a very effective, thorough and uniform penetration of the tobacco material with the superheated steam can be achieved.

The treatment period is defined as the period of time during which the tobacco material is contacted with the superheated steam. The contact with the superheated steam may be continuous or intermittent during the treatment period. In some embodiments, the treatment period is from about 3 minutes to about 12 minutes. In some embodiments, the treatment period is at least about 1 minute, 2 minutes, 3 minutes, 4 minutes, 5 minutes, 6 minutes, 7 minutes, 8 minutes, 9 minutes or about 10 minutes, and/or up to about 30 minutes, 25 minutes, 20 minutes, 15 minutes, 14 minutes, 13 minutes, 12 minutes, 11 minutes, 10 minutes, 9 minutes, 8 minutes, 7 minutes, 6 minutes, or about 5 minutes.

The inventors have found that the moisture content of the starting tobacco material is also an important parameter of the methods disclosed herein.

When referring to "moisture" it is important to understand that there are widely varying and conflicting definitions and terminology in use within the tobacco industry. It is common for "moisture" or "moisture content" to be used to refer to water content of a material but in relation to the tobacco industry it is necessary to differentiate between "moisture" as water content and "moisture" as oven volatiles. Water content is defined as the percentage of water contained in the total mass of a solid substance. Volatiles are defined as the percentage of volatile components contained in the total mass of a solid substance. This includes water and all other volatile compounds. Oven dry mass is the mass that remains after the volatile substances have been driven off by heating. It is expressed as a percentage of the total mass. Oven volatiles (OV) are the mass of volatile substances that were driven off.

Moisture content (oven volatiles) may be measured as the reduction in mass when a sample is dried in a forced draft oven at a temperature regulated to 110° C.±1° C. for three hours±0.5 minutes. After drying, the sample is cooled in a desiccator to room temperature for approximately 30 minutes, to allow the sample to cool. Unless stated otherwise, references to moisture content herein are references to oven volatiles (OV).

In some embodiments, the moisture content of the starting material is at least about 15% OV. It is thought that the presence of this moisture in the starting material helps to drive off the nicotine during the application of the superheated steam. In addition, it is believed that the moisture in the starting material helps to maintain and assure the physical integrity of the tobacco before, during and after the treatment process. In some embodiments, the tobacco material has a moisture content before the treatment of about 40% OV %. In some embodiments, the moisture content of the tobacco material before treatment with superheated steam is at least about 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39% or at least about 40% OV, and/or is up to about 45%, 44%, 43%, 42%, 41%, 40%, 39%, 38%, 37%, 36%, 35%, 34%, 33%, 32%, 31%, 30%, 29%, 28%, 27%, 26%, 25%, 24%, 23%, 22%, 21% or up to about 20% OV.

In some embodiments, the moisture content of the tobacco material is higher before the treatment than after the treatment. For example, in some embodiments, the tobacco material has a moisture content after the treatment of no more than about 15% OV, such as a moisture content after the treatment of from about 3% to about 15% OV.

Where the moisture content of the treated tobacco is low, the tobacco material is physically fragile. This is particularly the case where the tobacco material treated is leaf tobacco. Therefore, in some embodiments, the treated tobacco subsequently undergoes a further treatment step to increase the moisture content. For example, where tobacco material, such as leaf tobacco, has been treated with superheated steam and the moisture content has been reduced, for example to as low as 3% OV, the treated tobacco may immediately undergo reordering so as to increase its moisture content. In some embodiments, this is achieved by exposing the treated tobacco material to water and/or steam. In some embodiments, the moisture content is increased to above about 10% OV, or from about 10 to about 20% OV. In some embodiments, the reordering is carried out in a steam tunnel, a reordering drum, or the like.

In some embodiments, the removal of nicotine may be maximized by repeatedly treating the tobacco material with superheated steam as described herein. In such embodiments, the starting material is treated with superheated steam. The treated material with a reduced nicotine content will generally also have a reduced moisture content, which is then increased, for example by one or more of the above-mentioned techniques. Following this reordering step, the tobacco material may undergo a further round of treatment with superheated steam as described herein. These steps of treatment with superheated steam and reordering may be repeated until a desired nicotine level is achieved in the treated tobacco. In some embodiments of this repetitive method, the moisture content of the tobacco material before each step of treatment with superheated steam may be as low as 15% OV.

In some embodiments, one or more additive is applied to the tobacco material after the application of the superheated steam. In some embodiments, the additive is casing.

In some embodiments, the tobacco material is not contacted with an additive in order to significantly alter the pH of the material. In particular, according to embodiments of the methods disclosed herein, the pH of the tobacco is not adjusted to above 8 prior to or during the treatment with superheated steam.

In some embodiments, the chemical properties of the tobacco material change as a result of the treatment process.

In some embodiments, the sugar content of the tobacco material after the treatment is reduced compared to the sugar content of the tobacco material before the treatment. In some embodiments, the total sugar content of the treated tobacco is reduced by at least about 50% and by up to about 90% compared to the same tobacco material prior to the treatment.

In some embodiments, the ammonia content of the tobacco material after the treatment is reduced compared to the ammonia content of the tobacco material before the treatment. In some embodiments, the ammonia content of the treated tobacco is reduced by at least about 50% and by up to about 90% compared to the same tobacco material prior to the treatment.

In some embodiments, the chemical properties of the tobacco material are altered as a result of the treatment process, producing changes to the sensorial attributes to the treated tobacco material and or of aerosols formed from the tobacco material. In some embodiments, the sensorial properties of the tobacco material after the treatment are improved compared to the sensorial properties of the tobacco material before the treatment. For example, in the case of one tobacco blend tested, the sensorial properties of smoke from the combustion of the tobacco following treatment as disclosed herein was described as being smoother, easier to inhale, more balanced and less aggressive than the same tobacco blend without the treatment with superheated steam. Thus, the treatment has been shown to provide a smoother and "lower impact" smoking experience.

Overall, the quality of the sensorial attributes of the treated tobacco material is improved compared to the attributes of the same tobacco without the treatment. This renders the treated tobacco suitable for use in a variety of tobacco industry products, including cigarettes and tobacco heating products.

As used herein, the term 'tobacco material' includes any part and any related by-product, such as for example the leaves or stems, of any member of the genus *Nicotiana*. The tobacco material for use in the present invention is preferably from the species *Nicotiana tabacum*.

Any type, style and/or variety of tobacco may be treated. Examples of tobacco, which may be used, include but are not limited to Virginia, Burley, Oriental, Comum, Amarelinho and Maryland tobaccos, and blends of any of these types. The skilled person will be aware that the treatment of different types, styles and/or varieties will result in tobacco with different organoleptic properties.

The tobacco material may be pre-treated according to known practices.

The tobacco material to be treated may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other styles, varieties and/or types. Post-curing tobacco does not comprise or consist of cut rag tobacco.

In some embodiments, the tobacco starting material comprises cured tobacco. For example, the cured tobacco may be one or more selected from the group consisting of flue cured, air cured, dark air cured, dark fire cured and sun cured tobacco.

Alternatively or in addition, the tobacco material to be treated may comprise and/or consist of tobacco that has been processed to a stage that takes place at a Green Leaf Threshing (GLT) plant. This may comprise tobacco that has been re-graded, green-leaf blended, conditioned, de-stemmed or threshed (or not in the case of whole leaf), dried and/or packed. In some embodiments, the starting material is green tobacco or dried tobacco.

In some embodiments, the tobacco starting material is one or more selected from the group consisting of cut rag, thrashed leaf and tobacco stems.

In some embodiments, the tobacco material comprises lamina tobacco material. The tobacco may comprise between about 70% and 100% lamina material.

The tobacco material may comprise up to 50%, up to 60%, up to 70%, up to 80%, up to 90%, or up to 100% lamina tobacco material. In some embodiments, the tobacco material comprises up to 100% lamina tobacco material. In other words, the tobacco material may comprise substantially entirely or entirely lamina tobacco material.

Alternatively or in addition, the tobacco material may comprise at least 50%, at least 60%, at least 70%, at least 80%, at least 90%, or at least 95% lamina tobacco material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco. In some embodiments, the tobacco material does not comprise cut rag tobacco.

In some embodiments, the tobacco material comprises stem tobacco material. The tobacco may comprise between about 90% and 100% stem material.

The tobacco material may comprise up to 50%, up to 60%, up to 70%, up to 80%, up to 90%, or up to 100% stem tobacco material. In some embodiments, the tobacco material comprises up to 100% stem tobacco material. In other words, the tobacco material may comprise substantially entirely or entirely stem tobacco material.

Alternatively or in addition, the tobacco material may comprise at least 50%, at least 60%, at least 70%, at least 80%, at least 90%, or at least 95% stem tobacco material.

In some embodiments, the tobacco material to be treated may comprise and/or consist of reconstituted tobacco material.

In some embodiments, the tobacco material is processed in a single stage. In some embodiments, the treatment process is continuous. In alternative embodiments, the tobacco material is treated in batches.

In some embodiments, the tobacco material is uniformly and thoroughly treated. In some embodiments, the treated tobacco material is in a desired state and/or is optimally suitable for further processing. This may be achieved in a continuous process, which can be performed without storage of the tobacco forming part of the process.

In some embodiments, the method of treating tobacco material involves introducing said tobacco material into a pressurized treatment chamber, where it is contacted with the superheated steam, and then removing the treated material from the treatment chamber. In some embodiments, the material is conveyed continuously into and out of the treatment chamber, for example by means of a conveyor belt. In some embodiments, the conveyor belt is inclined obliquely upwards. In some embodiments, the treatment chamber is a hyperbarically pressurized treatment chamber (i.e. is a chamber at elevated or increased pressure).

In some embodiments, the tobacco material is mixed or agitated as it is treated, to ensure that the superheated steam is applied as uniformly as possible. For example, the tobacco may be conveyed by a mixing conveyor, such as a conveying screw. A obliquely inclined conveying screw may be particularly effective in blending the tobacco material, on the one hand by circulating it on the flanks of the conveying screw and on the other by the oblique inclination of the treatment chamber, since by the effect of gravity this causes the material to always tend somewhat to fall back on the conveying path. In this way, the tobacco material can be treated very uniformly and thoroughly with the superheated steam, and conveying the material in this way also allows the superheated steam sufficient time to penetrate into the deeper lying sections. Other embodiments may include the horizontal conveying of the tobacco material during treatment.

In some embodiments, the tobacco material is sprayed with the superheated steam.

An apparatus suitable for carrying out the methods disclosed herein comprises a pressurized treatment chamber. Optionally, the chamber is a hyperbarically pressurized treatment chamber.

In some embodiments, the apparatus includes supply nozzles for introducing the superheated steam into the treatment chamber. In some embodiments, the apparatus includes supply nozzles for applying one or more additives to the tobacco material before, during or after the application of superheated steam in the pressurized treatment chamber.

FIG. 1 is a schematic illustration of a suitable apparatus for carrying out the methods disclosed herein. The apparatus comprises a pressure proof screw conveyor 2, into which the tobacco material 12 is introduced via an infeed hopper 5 of a pressure differential proof cellular wheel sluice 4. The screw conveyor 2 comprises the transport screw 3, which is shown schematically and wherein in actual practice the outer edge of the transport screw 3 extends almost up to the inner wall of the casing of the screw conveyor 2. In the screw conveyor 2, superheated steam is sprayed in via various nozzles 1 distributed over the circumference and length of the casing of the screw conveyor 2.

In some embodiments, one or more additives, such as a casing medium, can also be supplied via the nozzles 1. In the interior of the screw conveyor 2, a particular process pressure and a particular process temperature are set for applying the superheated steam.

The transport screw 3, which may have a progressive pitch in the direction of the discharge cellular wheel sluice 8, conveys the tobacco material to the likewise pressure differential proof discharge cellular wheel sluice 8 and said discharge cellular wheel sluice 8 discharges the tobacco material out of the screw conveyor 2. The tobacco material, which once discharged has the reference numeral 15, is then guided via a discharge funnel 11 onto a conveying means 9 and leaves the steam leakage extraction hood 10.

The average dwelling time of the tobacco material in the screw conveyor 2 can be set, via the screw speed and/or the variable inclination of the screw conveyor 2. The inclination of the screw conveyor upwards can be continuously adjusted between an angle of greater than 0° and up to about 45°. Due to the scooping volume of the cellular wheel sluices 4, 8 and the gap between the cellular wheel rotor and the cellular wheel housing, a certain amount of steam leakage necessarily results, which escapes out of the screw conveyor 2 via the sluices and is extracted via steam extraction hoods 6 and 10. Since the steam leakage (7 and 13) represents a loss of energy and impedes the supply of the tobacco material into the cellular wheel chambers, the gap between the rotor and the housing may be minimized by generating an appropriate temperature difference between these two components, and the steam leakage rate thus significantly reduced. This means for controlling the temperature (via heating element 16) of the cellular wheel housing allows steam gaps or leakage to be minimized, the cellular wheel housing is temperature controlled via an adjusting circuit. This makes it possible to maintain an appropriate pressure burden range in the process chamber with reasonable steam leakage rates. The conditioning chamber and/or its components (transport screw 3, screw conveyor 2) can also be heated in order to avoid condensation.

The sluice steam extraction chamber 14 shown in FIG. 1 has the purpose of keeping the main steam leakage flow 13, which escapes out of the feed sluice 4, away from the tobacco material being fed in, so as to ensure that the cellular wheel chambers are filled. The main steam leakage flow 13 is therefore guided laterally past the tobacco material infeed hopper 5 and leaves the sluice steam extraction chamber 14 via a pipe towards the extraction hood 6.

The illustrated apparatus embodiment includes a valve 18 fitted in the screw conveyor 2 which allows liquid to be removed from the screw conveyor 2. For example, the valve 18 may be used when starting up the plant, to remove any condensation present. The pressure release valves 17 control steam mass flow release and also the operating pressure. These valves also control the final moisture content of the treated tobacco and, in part, the nicotine content of the treated tobacco, i.e. the nicotine removal or reduction.

The dwelling time of the tobacco material in the treatment chamber is sufficient to enable the tobacco material to be treated with the superheated steam for a period of from about 1 minute to about 30 minutes. In some embodiments, the dwelling time of the tobacco material in the treatment chamber is from about 3 minutes to about 12 minutes. In some embodiments, the treatment period is at least about 1 minute, 2 minutes, 3 minutes, 4 minutes, 5 minutes, 6 minutes, 7 minutes, 8 minutes, 9 minutes or about 10 minutes, and up to about 30 minutes, 25 minutes, 20 minutes, 15 minutes, 14 minutes, 13 minutes, 12 minutes, 11 minutes, 10 minutes, 9 minutes, 8 minutes, 7 minutes, 6 minutes, or about 5 minutes.

As a result of the treatment processes disclosed herein, a treated tobacco is provided which has reduced nicotine content compared to the tobacco material before treatment. In some embodiments, the nicotine content of the tobacco material after the treatment is at least about 40% less than the nicotine content of the tobacco material before the treatment, or wherein the nicotine content is up to about 80% less. In embodiments where the treatment process is repeated, the nicotine content of the tobacco material may be reduced as a result of each round of treatment. In some embodiments, the nicotine content of the tobacco material after treatment with superheated steam is reduced by at least about 20%, 25%, 30%, 35%, 40%, 45%, 50%, 55%, 60%, 65%, 70%, 75%, 80%, 85%, 90%, 91%, 92%, 93%, 94%, 95%, 96%, 97%, 98% or at least about 99% compared to the nicotine content of the tobacco material before treatment, and/or is up to about 85%, 90%, 95%, 96%, 97%, 98%, 99%, or up to about 100% compared to the nicotine content of the tobacco material before treatment.

The treated tobacco according to the present invention may be used in a tobacco industry product. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, lozenges and gum. This list is not intended to be exclusive, but merely illustrates a range of products, which are made and sold in the tobacco industry.

The treated tobacco material may be incorporated into a smoking article. As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products.

The treated tobacco material may be incorporated into components suitable for use with products or systems, such as consumable components containing tobacco for use in generating an aerosol in a non-smoking product or a nicotine-delivery system. One example is a consumable component containing tobacco to be heated by a tobacco-heating product (e.g. a heat-not-burn product). In some embodiments, such consumable components for tobacco heating products are distinguished from conventional cigarettes in that they may be arranged such that they cannot be combusted in the same way as a cigarette. Alternatively or in addition, the consumable component may be distinguished from a conventional cigarette by one or more of: the level of moisture in the tobacco; the density and/or type of tobacco; the type of wrapper used; and the level of ventilation provided into the component.

The treated tobacco material may be used for roll-your-own tobacco and/or pipe tobacco.

The treated tobacco material may be incorporated into a smokeless tobacco product. 'Smokeless tobacco product' is used herein to denote any tobacco product, which is not intended for combustion. This includes any smokeless tobacco product designed to be placed in the oral cavity of a user for a limited period of time, during which there is contact between the user's saliva and the product.

The treated tobacco material may be blended with one or more tobacco materials before being incorporated into a smoking article or smokeless tobacco product or used for roll-your-own or pipe tobacco.

Figure 2:
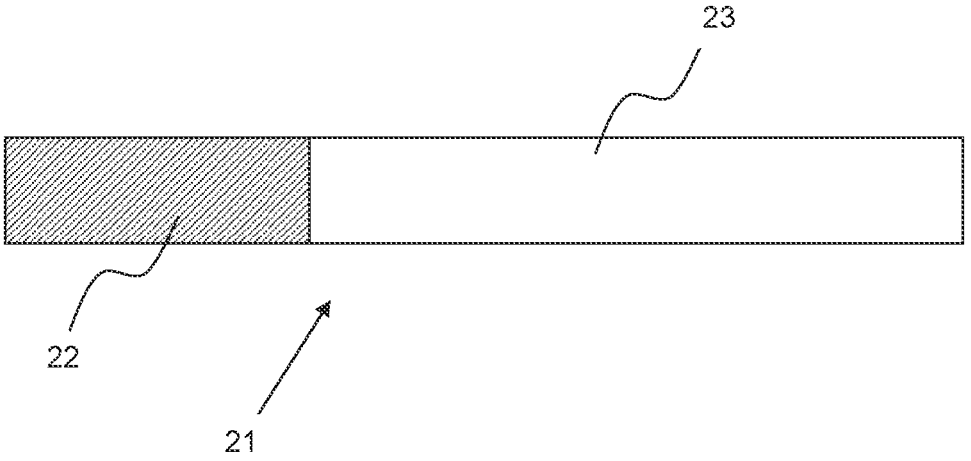
FIG. 2 is a schematic illustration of a smoking article including tobacco treated according to the disclosed methods.

Referring to FIG. 2, for purpose of illustration and not limitation, a smoking article 21 according to an exemplary embodiment of the invention comprises a filter 22 and a cylindrical rod of smokeable material 23, such as tobacco treated in accordance with the invention described herein, aligned with the filter 22 such that one end of the smokeable material rod 23 abuts the end of the filter 22. The filter 22 is wrapped in a plug wrap (not shown) and the smokeable material rod 23 is joined to the filter 22 by tipping paper (not shown) in a conventional manner.

EXAMPLE

Samples of tobacco material were treated in accordance with the process disclosed herein, whilst varying the process parameters as set out in the table of FIG. 3.

Tobacco Material 1 had a starting moisture content of 24% OV. Samples of Tobacco Material 1 were treated at three different pressures, namely 1.5, 2.5 and 3.5 bar(g). The samples were treated for 6 minutes at different temperature ranges (low: 140-150° C.; medium: 150-160° C.; and high: 160-170° C.).

Tobacco Material 2 had a starting moisture content of 33% OV. Samples of Tobacco Material 2 were all treated at the same process pressure, namely 2.5 bar(g). The samples were treated for 12 minutes at different temperature ranges (low: 140-150° C.; medium: 150-160° C.; and high: 160-170° C.).

Tobacco Material 3 had a starting moisture content of 33% OV. Samples of Tobacco Material 3 were all treated at 2.5 bar(g). The samples were treated for 3 or 6 minutes at the same temperature range (medium: 150-160° C.).

The treated tobacco was analyzed to determine the changes in sugar, ammonia and nicotine content. The results indicate how varying the process parameters influences the properties of the treated tobacco.

All of the treated tobacco exhibited a significant reduction in nicotine content. Furthermore, significant reductions in sugar content and ammonia content were also observed for all treated tobacco.

In order to address various issues and advance the art, the entirety of this disclosure shows by way of illustration various embodiments in which the claimed invention(s) may be practiced and provide for superior methods and treated materials. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of treating tobacco material with superheated steam having temperature of from about 100° C. to about 170° C. at a pressure of from about 0.05 bar(g) to about 10 bar(g) for a period of from about 1 minute to about 30 minutes, wherein the tobacco material has a moisture content before the treatment of at least about 15% OV, and wherein the nicotine content of the tobacco material after the treatment is reduced compared to the nicotine content of the tobacco material before the treatment and the ammonia content of the tobacco material after the treatment is reduced compared to the ammonia content of the tobacco material before the treatment.

2. The method as claimed in claim 1, wherein at least one of:

the nicotine content of the tobacco material after the treatment is at least about 20%, at least about 25% or at least about 40% less than the nicotine content of the tobacco material before the treatment; or the nicotine content of the tobacco material after the treatment is up to about 90% less than the nicotine content of the tobacco material before the treatment.

3. The method as claimed in claim 1, wherein the moisture content of the tobacco material is higher before the treatment than after the treatment.

4. The method as claimed in claim 1, wherein the tobacco material has a moisture content before the treatment of from about 20% OV to about 40% OV.

5. The method as claimed in claim 1, wherein at least one of:

the tobacco material has a moisture content after the treatment of no more than about 15% OV; or the tobacco material has a moisture content after the treatment of from about 3% to about 15% OV or from about 4% OV to about 7% OV.

6. The method as claimed in claim 1, wherein the method comprises treating the tobacco material for a period of from about 2 minutes to about 12 minutes.

7. The method as claimed in claim 1, wherein the pressure is from about 1 bar(g) to about 4 bar(g).

8. The method as claimed in claim 1, wherein the temperature of the superheated steam is from about 130° C. to about 170° C.

9. The method as claimed in claim 1, wherein the tobacco is treated in a continuous process.

10. The method as claimed in claim 1, wherein the tobacco material is introduced into and conveyed through a pressurized treatment chamber, and the superheated steam is sprayed on to the tobacco material as it is conveyed through the treatment chamber.

11. The method as claimed in claim 1, wherein the tobacco is treated in a batch process.

12. The method as claimed in claim 1, wherein the sugar content of the tobacco material after the treatment is reduced compared to the sugar content of the tobacco material before the treatment.

13. The method as claimed in claim 1, wherein the tobacco material undergoes two or more cycles of treatment with superheated steam having temperature of from about 100° C. to about 170° C. at a pressure of from about 0.05 bar(g) to about 10 bar(g) for a period of from about 1 minute to about 30 minutes.

14. The method as claimed in claim 10, wherein the tobacco material is agitated as it is conveyed through the pressurized treatment chamber.

15. The method as claimed in claim 10, wherein the tobacco is conveyed through the pressurized treatment chamber by a screw conveyor.

* * * * *